US009142103B2

(12) United States Patent
Robotham et al.

(10) Patent No.: US 9,142,103 B2
(45) Date of Patent: Sep. 22, 2015

(54) MASS NOTIFICATION ALARM AND SYSTEM WITH PROGRAMMABLE COLOR OUTPUT

(71) Applicant: UTC Fire & Security Americas Corporation, Inc., Bradenton, FL (US)

(72) Inventors: Martin Paul Robotham, Bradenton, FL (US); Thomas Greenwood, Terra Ceia, FL (US); Morris Stoops, Lenea, KS (US)

(73) Assignee: UTC FIRE & SECURITY AMERICAS CORPORATION, INC., Bradenton, FL (US)

( * ) Notice: Subject to any disclaimer, the term of this patent is extended or adjusted under 35 U.S.C. 154(b) by 0 days.

(21) Appl. No.: 13/886,566

(22) Filed: May 3, 2013

(65) Prior Publication Data

US 2014/0009301 A1 Jan. 9, 2014

Related U.S. Application Data

(60) Provisional application No. 61/667,586, filed on Jul. 3, 2012, provisional application No. 61/702,460, filed on Sep. 18, 2012.

(51) Int. Cl.
*G08B 3/00* (2006.01)
*G08B 5/38* (2006.01)

(52) U.S. Cl.
CPC ..... *G08B 5/38* (2013.01)

(58) Field of Classification Search
CPC ..... G08B 5/38
USPC ..... 340/691.1–691.5, 635, 628, 815.4, 340/815.45, 815.56, 815.73–815.76
See application file for complete search history.

(56) References Cited

U.S. PATENT DOCUMENTS

| | | | | |
|---|---|---|---|---|
| 4,962,687 | A | 10/1990 | Belliveau et al. | |
| 5,621,379 | A * | 4/1997 | Collins | 340/332 |
| 6,700,502 | B1 | 3/2004 | Pederson | |
| 6,705,745 | B1 | 3/2004 | Pederson | |
| 6,789,930 | B2 | 9/2004 | Pederson | |
| 7,006,003 | B2 * | 2/2006 | Zimmerman et al. | 340/815.4 |
| 7,038,593 | B2 | 5/2006 | Pederson | |
| 7,048,422 | B1 | 5/2006 | Solomon | |

(Continued)

FOREIGN PATENT DOCUMENTS

| | | | |
|---|---|---|---|
| CN | 1324398 | C | 2/2002 |
| CN | 100582916 | C | 8/2007 |

(Continued)

*Primary Examiner* — Eric M Blount
(74) *Attorney, Agent, or Firm* — Cantor Colburn LLP

(57) ABSTRACT

A mass notification system including one or more alarms for notification of two or more emergency classes. Each alarm can include a lens, a strobe for illuminating the lens with a first light color during activation of the strobe, and a light source such as a light emitting diode for illuminating the lens with a second light color different from the first light color during activation of the light source. During activation of the lens with the light source, the lens appears to be the color emitted by the light source. The alarm can be configured to notify occupants of a first emergency class by activating only the strobe and to notify occupants of a second emergency class by activating both the strobe and the light source. An alarm configured to provide notification of two or more emergency classes can thus use a single lens and a single strobe.

13 Claims, 3 Drawing Sheets

(56) References Cited

U.S. PATENT DOCUMENTS

| | | | | |
|---|---|---|---|---|
| 7,071,989 | B2 | 7/2006 | Nakata | |
| 7,080,930 | B2 | 7/2006 | Pederson | |
| 7,095,334 | B2 | 8/2006 | Pederson | |
| 7,106,378 | B2 | 9/2006 | Kawakami | |
| 7,153,013 | B2 | 12/2006 | Pederson | |
| 7,163,324 | B2 | 1/2007 | Pederson | |
| 7,372,499 | B2 | 5/2008 | Kawakami | |
| 7,484,870 | B2 | 2/2009 | Pederson | |
| 7,520,634 | B2 | 4/2009 | Ducharme et al. | |
| 7,527,389 | B2 | 5/2009 | Belliveau et al. | |
| 7,543,955 | B2 | 6/2009 | Belliveau et al. | |
| 7,600,891 | B2 | 10/2009 | Belliveau et al. | |
| 7,600,892 | B2 | 10/2009 | Belliveau et al. | |
| 7,636,049 | B2 * | 12/2009 | Ellul, Jr. | 340/584 |
| 7,663,500 | B2 | 2/2010 | Curran et al. | |
| 7,920,053 | B2 * | 4/2011 | Pattok et al. | 340/331 |
| 8,013,755 | B2 | 9/2011 | Rock et al. | |
| 8,026,828 | B2 | 9/2011 | Curran et al. | |
| 8,482,427 | B2 * | 7/2013 | Curran et al. | 340/815.45 |
| 8,624,754 | B2 * | 1/2014 | Savage, Jr. | 340/815.4 |
| 2002/0036908 | A1 | 3/2002 | Pederson | |
| 2004/0046676 | A1 | 3/2004 | Taylor | |
| 2004/0188644 | A1 | 9/2004 | Rappette et al. | |
| 2006/0181879 | A1 | 8/2006 | Pederson | |
| 2006/0250519 | A1 | 11/2006 | Kawakami | |
| 2007/0132575 | A1 * | 6/2007 | Ellul | 340/524 |
| 2008/0062302 | A1 | 3/2008 | Kawakami | |
| 2008/0062684 | A1 | 3/2008 | Belliveau et al. | |
| 2008/0062685 | A1 | 3/2008 | Belliveau et al. | |
| 2008/0074551 | A1 | 3/2008 | Kawakami | |
| 2008/0136960 | A1 | 6/2008 | Kawakami | |
| 2009/0059602 | A1 * | 3/2009 | Santos et al. | 362/351 |
| 2009/0072989 | A1 * | 3/2009 | Rock et al. | 340/691.1 |
| 2010/0033319 | A1 * | 2/2010 | Pattok et al. | 340/538 |
| 2010/0207777 | A1 * | 8/2010 | Woodford | 340/815.45 |
| 2011/0279285 | A1 | 11/2011 | Savage, Jr. | |
| 2012/0013480 | A1 | 1/2012 | Curran et al. | |
| 2012/0068853 | A1 | 3/2012 | Curran et al. | |

FOREIGN PATENT DOCUMENTS

| | | | |
|---|---|---|---|
| CN | 101025544 | A | 8/2007 |
| CN | 101409966 | A | 4/2009 |
| EP | 1176849 | B1 | 1/2002 |
| EP | 1543354 | B1 | 6/2005 |
| EP | 1584471 | A2 | 10/2005 |
| EP | 1701590 | B1 | 9/2006 |
| EP | 1701591 | B1 | 9/2006 |
| EP | 1887835 | A2 | 2/2008 |
| EP | 1940201 | A2 | 7/2008 |
| EP | 1945005 | A2 | 7/2008 |
| EP | 2040232 | A2 | 3/2009 |
| EP | 2265091 | A1 | 12/2010 |
| GB | 2392764 | A | 3/2004 |
| JP | 2002116481 | A | 4/2002 |
| JP | 2006285271 | A | 10/2006 |
| JP | 2007226250 | A | 9/2007 |
| JP | 2008003626 | A | 1/2008 |
| JP | 2008003627 | A | 1/2008 |
| JP | 2009042773 | A | 2/2009 |
| TW | I223123 | B | 11/2004 |

* cited by examiner

MASS NOTIFICATION ALARM AND SYSTEM WITH PROGRAMMABLE COLOR OUTPUT

CROSS REFERENCE TO RELATED APPLICATION

This application claims priority to provisional U.S. Patent Application Ser. No. 61/667,586 filed Jul. 3, 2012, and to provisional U.S. Patent Application Ser. No. 61/702,460 filed Sep. 18, 2012, each of which is incorporated herein by reference in its entirety.

FIELD OF THE EMBODIMENTS

The subject matter disclosed herein relates to mass notification systems and, in particular, to mass notification system alarms which can output notification of two or more emergency classes.

BACKGROUND OF THE EMBODIMENTS

In recent years, the field of mass notification has developed in response to the threat of terrorist attacks on civilian and government facilities, the threat of violence on school and university campuses, the danger afforded by natural and/or man-made hazards, and other events that require the emergency management of a large group of people.

Regardless of the type of emergency, authorities must be able to communicate quickly and clearly with all people who are or may be affected by the emergency. A mass notification system provides this capability and permits real-time information to be disseminated to all people in the immediate vicinity of a building or larger geographic area during and after an emergency using graphical information, textual information, visible signaling, audible signaling, intelligible voice communications, and the like. When properly designed and implemented, a mass notification system can save lives.

In the United States, the field of mass notification is addressed/regulated by entities that include, but are not limited to, the Department of Defense (DoD), the Occupational Health and Safety Administration (OSHA), the National Fire Protection Association (NFPA), and the Federal Emergency Management Agency's (FEMA). For example, OSHA 1910.165 requires employers that use an alarm system to provide warning for necessary emergency action as called in the emergency action plan or reaction time for safe escape of employees from the work place, the immediate work area, or both. As another example, Annex E of the National Fire Protection Association (NFPA) 72 provides requirements for the application, installation, location, performance and maintenance of a mass notification system ("MNS"). As yet another example, the Federal Emergency Management Agency's (FEMA) Outdoor Public Alerting System Guide (December 2004) advocates, "using voice technology to address all natural and man-made hazards, including acts of terrorism and requires that all warning systems be operable in the absence of AC supply power."

Systems configured to integrate mass notification capability to an existing notification system such as a fire system are known. For example, U.S. Pat. No. 8,013,755, which is commonly assigned herewith and incorporated herein by reference in its entirety, describes the use of a white strobe to indicate a fire emergency in which occupants must evacuate and an amber strobe to indicate a mass notification in which occupants must await instructions.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

In an embodiment of the present teachings, a signaling device can include a lens having a lens cavity, a strobe configured to output a first color, wherein the strobe is configured to illuminate the lens with the first color during activation of the strobe, and a light source configured to output a second color which is different from the first color, wherein the light source is configured to illuminate the lens with the second color during activation of the light source, wherein the signaling device is configured to activate the strobe and deactivate the light source during a first emergency class, and to activate both the strobe and the light source during a second emergency class.

In another embodiment of the present teachings, a mass notification system can include a signaling device. The signaling device can include a lens having a lens cavity, a strobe configured to output a first color, wherein the strobe is configured to illuminate the lens with the first color during activation of the strobe, and a light source configured to output a second color which is different from the first color, wherein the light source is configured to illuminate the lens with the second color during activation of the light source. The mass notification system can further include a controller configured to activate the strobe and deactivate the light source during a first emergency class, and to activate both the strobe and the light source during a second emergency class, and a sensor configured to detect at least one of the first emergency class and the second emergency class and to provide emergency class data to the controller.

In another embodiment of the present teachings, a method for emergency notification may include, during a first emergency event, activating a strobe, wherein the strobe outputs a first color to illuminate a lens with the first color and activating a light source, wherein the light source outputs a second color different from the first color to illuminate the lens with the second color. The method may further include, during a second emergency event, activating the strobe, wherein the strobe outputs the first color to illuminate the lens with the first color, and deactivating the light source.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the exemplary embodiments of the present teachings, examples of which are illustrated in the accompanying drawings. Wherever possible, the same reference numbers will be used throughout the drawings to refer to the same or like parts.

For purposes of this disclosure, "deactivate" refers to turning off a light source for a sustained period of time, for example during an entire emergency event, "activate" refers to turning on a light source during an emergency event, "continuous activation" refers to turning on a light source for a sustained period of time, for example during an entire emergency event, and "pulse" refers to a turning on and turning off a light source for cyclical timed periods during an emergency event. The terms "pulse" and "continuous activation" are used as subsets of light source "activation."

Conventional emergency notification systems may include an alarm which uses of a strobe. The strobe can output such a high intensity light that an occupant would have difficulty in identifying a color of the light by direct observation during the strobe. Further, conventional systems which have the ability to output multiple notification types may require a different device for different events, and therefore have a high device count and a high cost. Prior systems therefore may require increased stock and assembly costs, for example due to the use of two or more light sources and/or two or more lenses, or the use of esoteric and/or expensive materials.

An embodiment of the present teachings may include a system which uses a single strobe and a single lens, and selectively illuminates the lens so that it has the appearance of two or more different colors at different times based on the type of emergency. Further, an embodiment of the present teachings may include a notification system having an alarm which allows alarm color detection by an occupant between strobe pulses during a period of relatively low brightness compared to the relatively high brightness during the strobe pulse.

Figure 1:
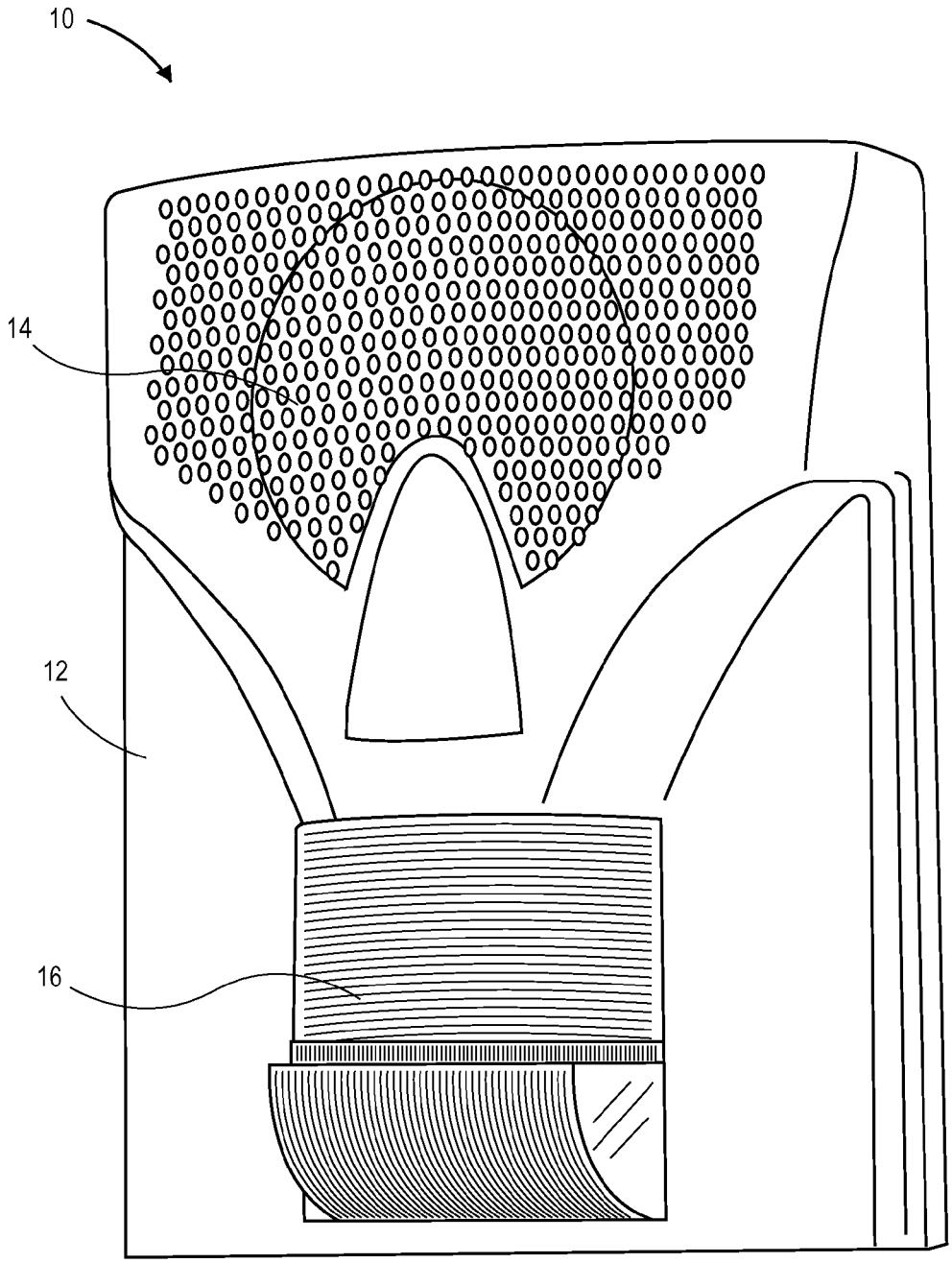
FIG. 1 is a perspective depiction of a mass notification system alarm.

FIG. 1 is a perspective depiction of an alarm 10 which, in accordance with an embodiment of the present teachings, can be part of a mass notification system. The alarm 10 may include a housing 12 and a grill 14, which may be formed as part of the housing 12. The grill 14 may include openings through which audible output from a speaker (not individually depicted for simplicity) encased by the housing 12 can pass. FIG. 1 further depicts a lens assembly which includes a clear or translucent lens 16. If colored (i.e., not clear), the lens will typically be a white translucent lens.

Figure 2:
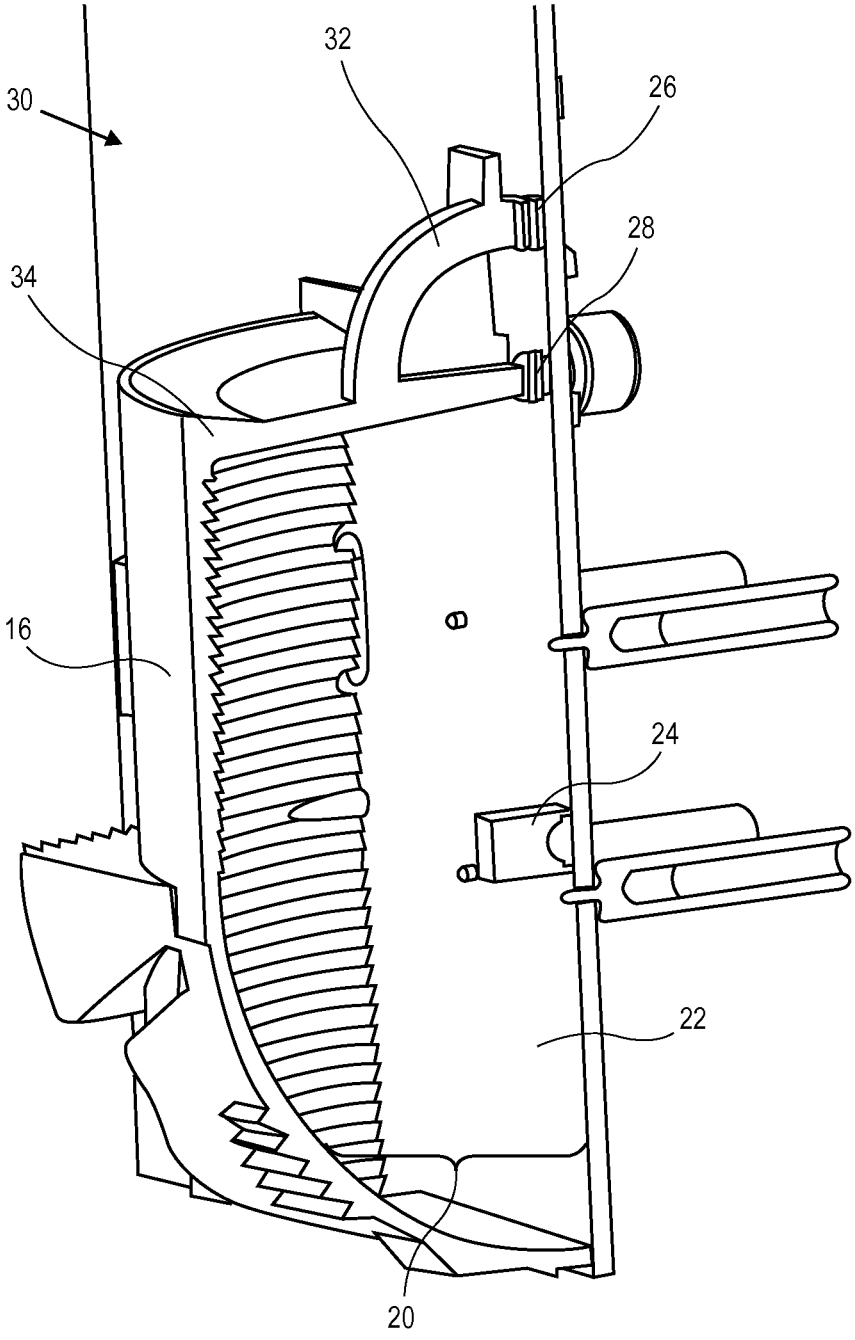
FIG. 2 is a perspective depiction of a portion of the mass notification system alarm of FIG. 1.

In an embodiment, the lens 16 may include a hollow lens cavity 20 as depicted in the cutaway perspective view of FIG. 2, which is magnified and oblique compared to the FIG. 1 view. Further, the housing 12 has been removed in the FIG. 2 view. FIG. 2 further depicts that the lens assembly is mounted (attached) to a printed circuit board (PCB) 22, although the lens 16 can be physically attached to either the housing 12, the PCB 22, or both. FIG. 2 further depicts a high intensity strobe 24 such as a xenon flash tube or light emitting diode (LED) attached to the PCB 22, which is able to output, for example, white light. FIG. 2 further depicts a first colored light source 26 such as a first LED, and an optional second colored light source 28 which may be a second LED, both of which are attached to the PCB 22. In an embodiment, the first LED 26 and the optional second LED 28 may each output only one color, a color which is different than the strobe color. In another embodiment, the first LED 26 and the optional second LED may selectively output one of a plurality of colors, one of which can be the same as the strobe color, for example if the LEDs 26, 28 are red-green-blue (RGB) LEDs. The strobe 24, the first colored light source 26, and the optional second colored light source 28 may be electrically coupled to, and electrically controlled by, the PCB 22.

In an embodiment, the light from the first colored LED 26 may be output in a horizontal direction which is generally perpendicular to a major, generally vertical surface 30 of the PCB 22, and directed into the hollow lens cavity 20 by a light pipe 32 such that the light enters the hollow lens cavity 20 in a generally vertical direction which is generally parallel to the major, generally vertical surface 30 of the PCB 22. The light pipe 30 may be a plastic or polymer material which is molded as part of the lens assembly which includes the lens 16 and the light pipe 30. In another embodiment, the light pipe 30 may be a separate structure such as a fiber optic cable (not depicted for simplicity). In yet another embodiment, the first LED 26 may be mounted on the PCB 22 such that the light from the first LED 26 is output directly into the cavity 20.

To aid light diffusion and increase the intensity of the light output by the first LED 26 onto the front of the lens 16, the PCB 22 can be manufactured from a white or light-colored resin material. In another embodiment, a white or light colored coating can be applied to the PCB during the fabrication process. For example, the PCB can be coated with a light or white color solder resist mask to increase the intensity and/or diffusion of light reflected from the PCB.

The light from the optional second LED 28 can be output in a generally horizontal direction which is generally perpendicular to the major, generally vertical surface 30 of the PCB 22, and collimated in a horizontal direction by a horizontal upper surface 34 of the lens assembly.

Figure 3:
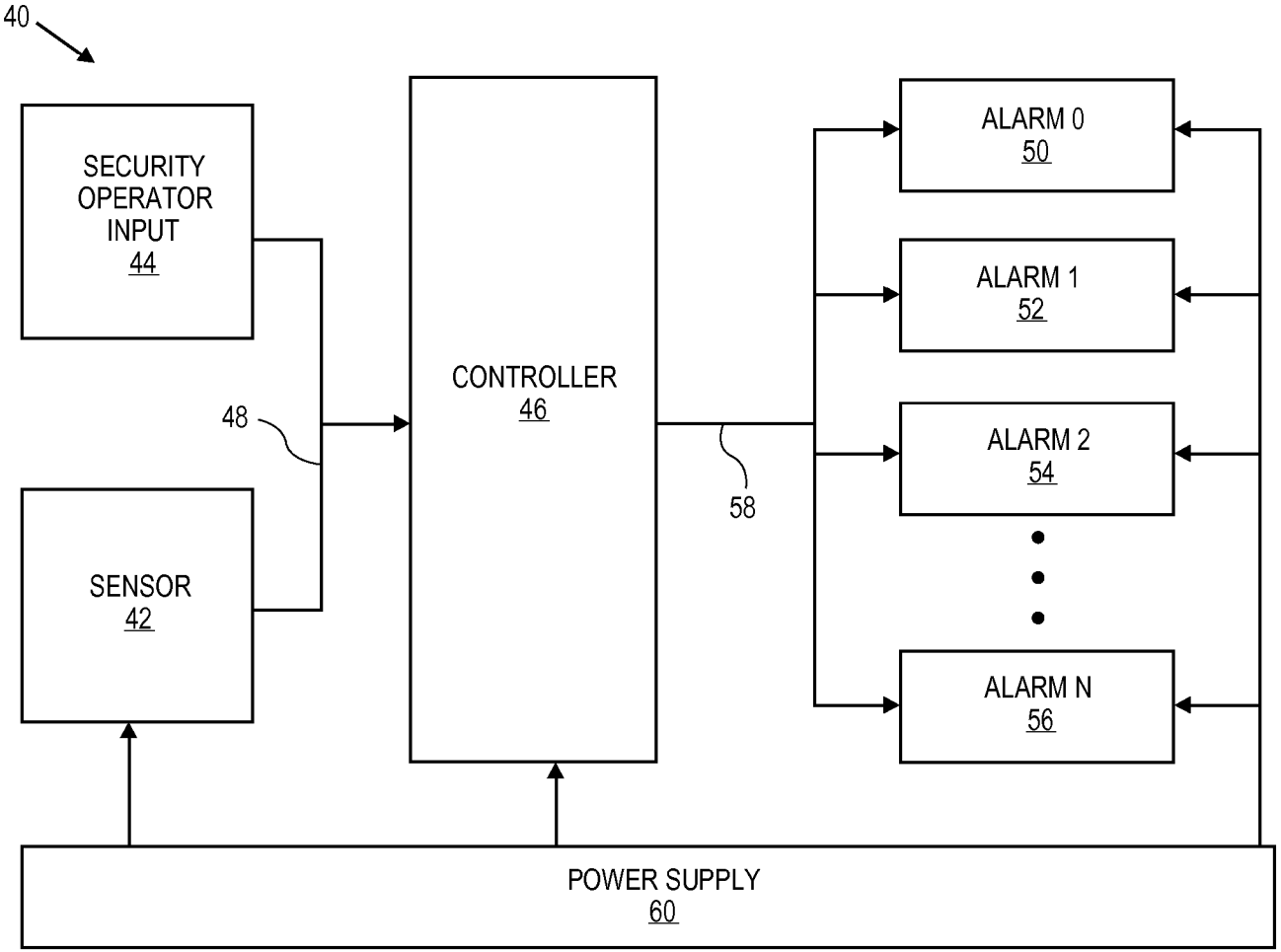
FIG. 3 is a schematic depiction of a mass notification system including a plurality of alarms.

FIG. 3 is a schematic depiction of a notification system 40 in accordance with an embodiment of the present teachings. An emergency event may be automatically detected by one or more sensors 42 such as a smoke sensor, gas sensor, or motion sensor. In an embodiment, a security operator may provide input 44, such as intruder notification. The emergency class information (e.g., fire, intruder, etc.) is provided to a controller 46, for example by digital instructions through a first digital data bus 48. Upon receipt of the emergency class, the controller 46 outputs digital instructions to the PCB(s) 22 (FIG. 2) of one or more alarms 50-56, for example through a second digital data bus 58.

An operational state of the strobe 24, the first light source 26, and the second light source 28 may be different, depending on the emergency class received by the alarm PCB 22 from the controller 46. In other words, the controller 46 in conjunction with the alarm PCB 22 may selectively activate or deactivate the first LED 26 and strobe 24 in a operational manner corresponding to the emergency class input from the controller 46 to activate the strobe and deactivate the light source during a first emergency class activate both the strobe and the light source during a second emergency class. In the case of an intruder, occupants are to be notified to await instructions, for example with an amber light. In this case, the PCB 22 can pulse the strobe 24 according to known strobe operating techniques, for example by applying a positive input voltage to the strobe to illuminate the lens cavity 20 and the lens 16 with white light. Further, the PCB 22 can activate the first light source 26 by applying a positive input voltage to the first light source 26 to illuminate the lens cavity 20 and the lens 16 with amber light to give the appearance of an amber strobe from the exterior of the lens 16 when viewed by an occupant. The first light source 26 may be continuously activated to produce amber light continually, or the first light source 26 can be pulsed out of sync with the strobe pulses to save power. Illuminating the lens cavity 20 with amber light between strobe pulses allows occupants to directly observe the amber-appearing lens 16 of the alarm 10 during periods of relatively low intensity brightness output by the first light source 26 compared to the periods of relatively high intensity brightness during strobe pulses. This compares to some prior systems where an observer would have difficulty in detecting an amber strobe color by direct observation of an amber strobe because of its high intensity.

In the case of a fire, occupants are to be notified to evacuate the building. In this case, the strobe 24 may be pulsed to illuminate the lens with white light and the first light source 26 may be deactivated during the fire event.

In an embodiment, the first light source 26 is capable of outputting only a single color (e.g., amber) which is different than the color output by the strobe. The first light source 26 is thus deactivated during a fire event, and is activated during a second emergency class. In this embodiment, the alarm can be programmed for two different events, a fire event where the lens appears white through illumination of the clear or white lens by the strobe and an intruder event where the lens appears amber between strobe pulses through illumination of the lens by the first light source 26 with amber light.

In another embodiment, the first light source 26 is capable of producing more than one color. For example, the first light source 26 may be an RGB LED. A specific color is selected through the application of a specific voltage to each of three or more RGB LED inputs. In this case, an emergency class is received by the PCB 22, and the PCB 22 can activate the RGB LED and applies an LED input voltage to the RGB LED such that it outputs a color corresponding to the emergency class. If a fire is detected, the PCB 22 may deactivate the LED so that only the strobe is activated during the fire notification and the white or clear lens appears white. If another emergency class is detected, the PCB can apply an input voltage to the LED such that the LED emits a color corresponding to the emergency class. For example, if an intruder is detected, the PCB 22 can apply an LED input voltage which causes the RGB LED 26 to emit an amber color either continually or between strobe pulses to save power so that the lens has the appearance of the color associated with the detected emergency class. If an emergency event other than a fire event or an intruder event is detected, the PCB 22 can apply an LED input voltage which causes the RGB LED 26 to emit a different color which corresponds to the emergency event, and to illuminate the lens 16 with the color such that the lens has the appearance of the color during the emergency event. Thus the use of a first light source 26 which can output a plurality of colors may result in an alarm 10 which can be used for a plurality of different emergency classes.

In an embodiment similar to the use of a single, multiple color RGB LED as a first light source 26 to output multiple colors, it is contemplated that a plurality of single-color LEDs may be selectively activated by the PCB one at a time to give the lens 16 the appearance of a color which corresponds to the emergency event.

The optional second light source 28 may be used during an emergency event to provide an alarm light bar in the alert color. A light bar can include a region of higher color intensity (i.e., higher color saturation) than the light within the cavity 20 of the lens 16 so that the color is more easily identified by an occupant. In an embodiment, the light bar may be formed by light output from the second LED 28 and collimated by the upper surface 34 of the lens assembly. The second light source 28 may output the same color which is output by the first light source 26, and can be similarly activated (either continuously activated during strobe pulses, pulsed out of sync with the strobe pulses to reduce power, or deactivated during an emergency event such as a fire event). In another embodiment, the first light source 26 can be configured to both illuminate the lens cavity 20 and to provide a light bar, for example by collimating a portion of the first light source output using the horizontal upper surface 34 of the lens assembly.

FIG. 3 further depicts one or more power supplies 60 which can be used to power the one or more sensors 42, the controller 46, and/or the alarms 10, 52-56. While FIG. 3 depicts an embodiment where the power supply 60 to each alarm 50-56 and the digital data bus 58 are separate, it will be understood that power can be supplied and data can be transmitted over the same bus, for example over the same pair or plurality of wires.

Thus a traditional mass notification system has visible notification to devices to alert occupants (particularly hearing-impaired occupants) to different emergent conditions (e.g., a white strobe to indicate "fire-leave the building" and an amber strobe to indicate "alert-prepare to receive instructions"). A strobe may be so bright that an occupant would have difficulty in identifying the color of the light by direct observation. Various embodiments of the present teachings may include the use of an alarm with a single white strobe, while the apparent color of the lens is changed on demand using a light source such as an LED to illuminate a lens and to indicate the nature of the alert through a specific color. A clear or transparent lens may be colorized by illuminating the lens with colored light, giving the lens the appearance of color between strobe flashes. By turning off the colored light, the basic clear/white color is achieved during the strobe pulse. Using a single light source to illuminate the lens (e.g., using an LED) selectively colorizes the lens with a single color (if a single color LED is used) or with one of a plurality of colors (if a three-source RGB LED with individual intensity control on each LED is used) during and/or between strobe pulses. The RGB LED can thus be used to provide programmable lens color. The lens may also have a light bar, which can be driven by a separate LED, to further indicate the alert color. One way to achieve the colorization of the lens is to use a light pipe to bring light to the rear of the lens, and a white or light colored reflective base surface (for example the surface of the PCB) to diffuse the light. Energy can be conserved by turning off the colorization of the first light source 26 and the optional second light source 28 when the strobe fires (i.e., pulsing the colorization out of sync with the strobe pulse).

An embodiment can provide mass notification with a single strobe and a single lens using no colored lens filters. An embodiment can provide a decreased part count compared to some conventional systems. Mounting options within a room for a single lens system can be improved as a physical depth of the alarm can be decreased compared to some systems which use two strobes and two lenses, and the physical depth may be half of a conventional system. For example, while a physical depth of an alarm which uses two strobes and two lenses has a depth (thickness) greater than about 50 mm, an alarm according to an embodiment of the present teachings can signal two or more emergency events and may have a depth, from a back surface of the alarm to a front surface of the lens or housing, of less than about 25 mm. A conventional system including a fixed mounting protrusion of 25 mm, a first lens protrusion of 25 mm, and a second lens protrusion of 25 mm would occupy a depth of 75 mm. In contrast, an alarm according to an embodiment of the present teachings can include a fixed mounting protrusion of 25 mm and a lens protrusion of 25 mm or less, for a room protrusion of 50 mm or less.

Further, an alarm according to an embodiment of the present teachings which uses a white strobe and a white or clear lens can have a reduced power draw compared to conventional systems which use colored strobes or colored lenses. For a given power input, a white strobe outputs a given light transmission or intensity. For the same power input, an amber strobe outputs 80% of the light transmission, requiring a 25% power increase (1.25 times the power) to output the same light intensity. For the same power input, a red strobe outputs 40% of the light transmission, requiring a 150% power increase (2.5 times the power) compared to a white strobe to output the same light intensity. A colored lens can also greatly attenuate the light intensity output from a strobe, and more power must be input to the strobe to increase the light intensity output by the alarm. Thus using a white strobe, one or more colored LEDs, and a clear lens according to an embodiment of the present teachings can provide an alarm and system which can provide notification of more than one type of emergency event and has reduced power draw compared to conventional systems.

Additionally, an embodiment of the present teachings can provide improved installation flexibility, as a single alarm can be used for multiple applications.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A mass notification system, comprising:

a signaling device, comprising:

a lens having a lens cavity;

a strobe configured to output a first color, wherein the strobe is configured to illuminate the lens with the first color during activation of the strobe; and a light source separate from the strobe, the light source configured to output a second color which is different from the first color, wherein the light source is configured to illuminate the lens with the second color during activation of the light source;

a controller configured to activate the strobe and deactivate the light source during a first emergency class, and to activate both the strobe and the light source during a second emergency class;

a sensor configured to detect at least one of the first emergency class and the second emergency class and to provide emergency class data to the controller;

a light pipe configured to direct light output from the light source into the lens cavity, wherein the light pipe is molded as part of a lens assembly which comprises the lens; and a printed circuit board (PCB), wherein the light source and the lens are attached to the PCB and the signaling device is configured such that light from the light source is output in a direction which is generally perpendicular to a major, generally vertical surface of the PCB and is directed by the light pipe into the lens cavity such that the light enters the lens cavity in a generally vertical direction which is generally parallel to the major, generally vertical surface of the PCB.

2. The signaling device of claim 1 wherein the signaling device is configured to activate the strobe and deactivate the light source during a first emergency class and to activate both the strobe and the light source during a second emergency class.

3. The signaling device of claim 2, wherein the light source is configured to pulse out of sync with the strobe during the second emergency class.

4. The signaling device of claim 2, wherein the light source is configured for continuous activation during the second emergency class.

5. The signaling device of claim 1, further comprising:

the signaling device is configured to activate the strobe and deactivate the light source during a first emergency class, to activate the strobe and the light source during a second emergency class such that the light source outputs the second color during the second emergency class, and to activate the strobe and the light source during a third emergency class, wherein the light source outputs a third color different from the second color during the third emergency class.

6. The signaling device of claim 5, wherein the signaling device is configured to pulse the light source out of sync with the strobe during the second emergency class and the third emergency class.

7. The signaling device of claim 5, wherein the signaling device is configured to continually activate the light source during the second emergency class and the third emergency class.

8. The signaling device of claim 1, wherein the light source is a first light source and the signaling device further comprises a second light source configured to provide a light bar during activation of the second light source.

9. The signaling device of claim 1, wherein the signaling device is one of a plurality of signaling devices configured as a signaling device.

10. The signaling device of claim 1, wherein the lens is a clear lens.

11. The signaling device of claim 1, wherein the lens is a white translucent lens.

12. The signaling device of claim 1 wherein the lens, the strobe, and the light source are part of a signaling device alarm, and a depth of the alarm from a back surface of the alarm to a front surface of the lens is less than about 50 mm.

13. The mass notification system of claim 1, wherein the light source is a light emitting diode configured to output only the second color.

* * * * *